United States Patent [19]

Church et al.

[11] 4,049,256

[45] Sept. 20, 1977

[54] DOCUMENT ALIGNMENT ASSEMBLY

[75] Inventors: John Allen Church; Paul Feinstein, Jr.; Ronald Eugene Hunt, all of Austin; Louis Marion McDaniels, Round Rock; Paul Francis Munch, Austin, all of Tex.

[73] Assignee: International Business Machines Corporation, Armonk, N.Y.

[21] Appl. No.: 693,820

[22] Filed: June 7, 1976

[51] Int. Cl.[2] ..... B65H 5/26; B65H 9/16

[52] U.S. Cl. ..... 271/9; 101/232; 271/225; 271/233; 271/236; 271/242; 271/251; 271/267

[58] Field of Search ..... 271/9, 225, 233, 251, 271/239, 236, 250, 184, 226, 247, 267, 242, 243.2; 214/1 M, 6 M; 101/232; 198/448; 270/12, 58

[56] References Cited

U.S. PATENT DOCUMENTS

| | | | |
|---|---|---|---|
| 2,825,281 | 3/1958 | Heywood | 271/225 X |
| 3,048,099 | 8/1962 | Davidson et al. | 270/12 X |
| 3,100,112 | 8/1963 | Davis et al. | 271/242 |
| 3,371,926 | 3/1968 | Anderson et al. | 271/225 X |
| 3,669,537 | 6/1972 | Kobayashi | 271/9 X |
| 3,908,986 | 9/1975 | Bleau | 271/251 X |
| 3,929,328 | 12/1975 | Knappe et al. | 271/267 |
| 3,964,672 | 6/1976 | Aylsworth et al. | 271/10 X |

*Primary Examiner*—Bruce H. Stoner, Jr.
*Attorney, Agent, or Firm*—John L. Jackson

[57] ABSTRACT

Disclosed is an alignment assembly for accurately aligning separate sets of documents being inserted into the assembly from transversely oriented feed paths, the alignment assembly including a pivotally mounted document gate which provides not only guide passageways for documents entering the assembly, but also an alignment edge for accurately positioning and aligning documents within the assembly in document clamps adapted to transport the documents from the alignment assembly to a print station and thereafter to an exit transport assembly. The movement of documents inserted in the alignment assembly is effected by a document aligner assembly comprising cooperating vibratory document transporters and pivotally mounted back-up rollers for simultaneously urging the documents into the clamps and against the alignment edge of the document gate.

7 Claims, 2 Drawing Figures

DOCUMENT ALIGNMENT ASSEMBLY

This invention pertains to a method and apparatus for aligning documents transported to a common situs along converging transversely oriented transport paths, more particularly to a document alignment assembly for aligning and registering documents inserted into the assembly from transversely oriented paths, and even more particularly to an improved document alignment assembly employed in high-speed print systems.

Documents are commonly transported through apparatus, such as print systems, between respective feed, alignment, print, and output stations. While many of such systems are effectively designed to rapidly transport documents of one type or size therethrough, effective systems are presently unknown for the essentially simultaneous transport of various types of documents through the system.

It is therefore a principal object of the present invention to provide a new and improved method and apparatus for the simultaneous transport of various types of documents through a system, particularly a high-speed printer system.

It is a further object of the invention to provide a new and improved method and apparatus for aligning separate types of documents transported along separate feed paths which converge at a common alignment station.

It is an even further object of the invention to provide a new and improved alignment assembly for receiving documents inserted therein from transversely oriented feed paths and aligning said inserted documents with a common transport assembly for removing selected ones of the documents from the alignment assembly.

Figure 1:
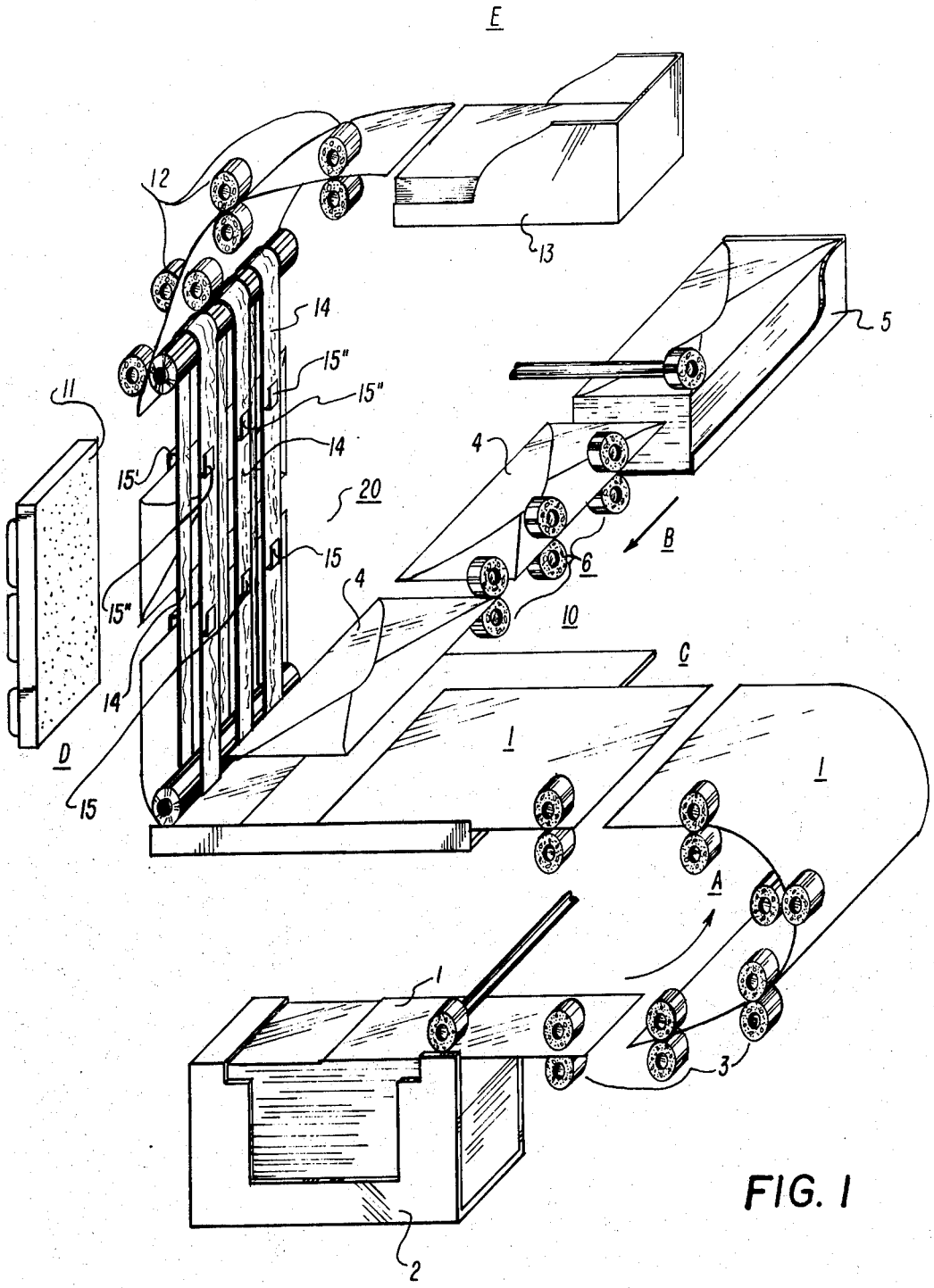
Figure 2:
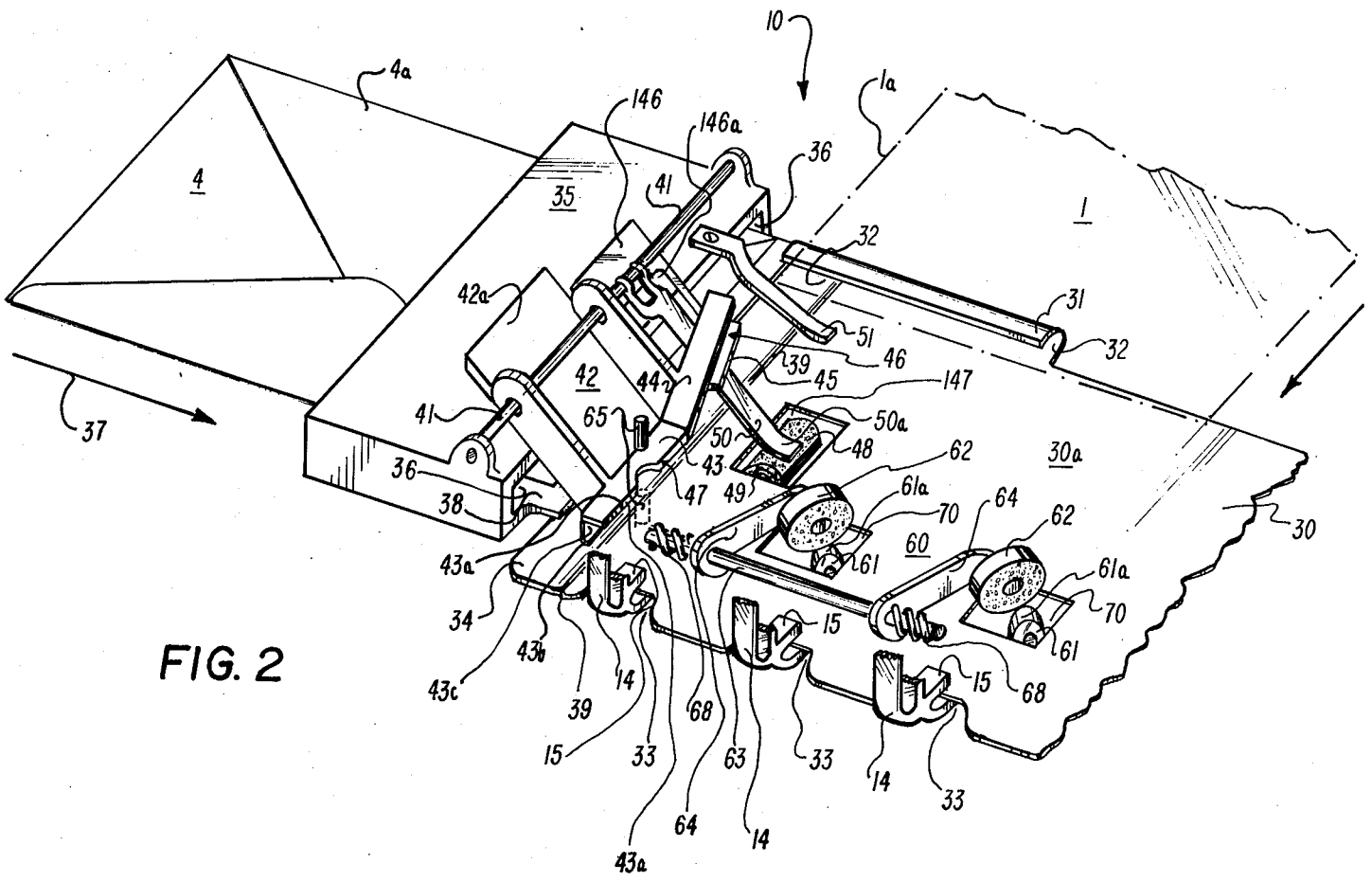

Specific features of the invention, as well as specific objects and advantages thereof, will become readily apparent from the following detailed description, taken in conjunction with the accompanying drawings in which:

FIG. 1 is a diagrammatic representation of an overall high-speed printer system illustrating the transport of separate sets of documents through the system to a common alignment station where the documents are subsequently transported past a print station and thereafter exit the assembly; and FIG. 2 is a pictorial illustration of a preferred embodiment of the alignment assembly disposed at the alignment station depicted in FIG. 1 is accordance with the present invention.

The drawings are not necessarily to scale, and in some instances portions have been exaggerated in order to emphasize particular features of the invention.

Referring initially to FIG. 1, an overall high-speed printer system is schematically illustrated whereby separate sets of documents are respectively transported along separate feed transport paths A and Bwhich converge at a common alignment station C where individual ones of the documents are aligned with, and engaged by, a print transport assembly 20 for advancement past a print station D and thereafter, by way of a single transport path, to an output station E where the printed documents are collated or stacked. As used throughout the present description, the term "documents" means and refers to sheet-like articles of a generally flexible nature; and would include, for example, paper, envelopes, cards, and the like.

Specifically, a stack of a first set of documents 1 contained within a supply drawer or bin 2 are transported (by way of a suitable feed transport assembly 3) along the transport path A to an alignment assembly 10 disposed at the alignment station. Similarly, a stack of a second set of documents 4 disposed in a supply drawer or bin 5 are transported (by way of suitable feed transport assembly 6) along the separate transport path B to the alignment assembly 10, the transport paths A and B converging and transversely intersecting one another (normally at a substantially ninety degree angle) at the alignment station C.

In a typical application, the first set of documents might be blank sheets of paper of one dimension while the second set of documents might be blank sheets of a different dimension, the specific nature, size, or character of the different sets of documents 1 and 4 not being critical to the present invention, it only being necessary that the documents of each set be respectively transported along separate transport paths (two being shown in FIG. 1) to the common alignment station, In the illustrated embodiment of FIG. 1, the documents 1 (transport path A) are blank sheets of paper while documents 4 (transport path B) are envelopes.

Suitable control apparatus (not shown) is employed to rapidly, and sequentially, insert separate documents from either the transport path A or the transport path B into the alignment assembly 10 disposed at the alignment station. In accordance with the present invention, the details and features of which are subsequently described, the alignment assembly 10 accurately aligns and registers the so inserted documents with the print transport assembly 20, which assembly gripably engages the so aligned and registered document for subsequent controlled advancement past print apparatus 11, each document (after the print operation) thereafter being transferred to an exit transport assembly 12 which ejects the so printed document into a stacking bin 13, for example. Various types of printers may be employed for the apparatus 11, the present system contemplating a computer-controlled ink jet printer for printing the documents 1 and 4.

In accordance with a preferred embodiment, the print transport assembly 20 depicted in FIG. 1 comprises a plurality of pulley driven parallel spaced continuous belts 14 (three being shown in FIG. 1), adjacently disposed belts having mutually linearly aligned sets of clamps 15, 15', 15'', etc., effective to gripably engage each document (at its edge) which is inserted into the alignment assembly 10 and transport that document, initially to the print station D, and thereafter to the exit transport assembly 12. To effect accurate printing at the print station, it is essential that the edge of each document be accurately and linearly aligned within the particular set of clamps, such alignment being uniquely effected by the alignment assembly 10 of the present invention, the details and operation of which are now described.

Accordingly, and with reference now to FIG. 2, the alignment assembly 10 of the present invention comprises a base plate 30 having an up-turned end portion 31 defining an elongated channel 32. At the opposite end from the end portion 31 are cut-outs 33 in which a set of clamps (say, 15) which are attached to the belts 14 can be positioned. Disposed immediately adjacent an edge 34 of the base plate is a housing 35 having a channel 36 through which each document 4 is transported to the main alignment area **30*a* of the base plate 30. Specifically, the base of the channel 36 terminates in a ledge portion 38 aligned with or disposed slightly above the top of the edge 34. Thus, each document 4 entering the housing 35 in the direction of the arrow 37 passes through the channel 36 along the ledge 38 where it thereafter drops down onto or engages the edge 34 of the base plate 30**.

As a unique feature, and for the reason subsequently described, the top surface of the edge portion 34 is disposed slightly below the major alignment portion or area 30*a* of the base plate and joined therewith by way of an inclined surface 39. Thus, the envelopes 4 are transported up the inclined surface 39 to the major portion 30*a* of the base plate 30, the channel 32 being so aligned with the channel 36 to provide a passageway through which the elongated end 4*a* of the envelope is guided. On the other hand, the documents 1 (from transport path A) are transported (in the direction of the arrow 40) over the top of end portion 31 to pass into the main alignment area 30*a* of the base plate 30 in the manner depicted in FIG. 2.

Pivotally mounted to the housing 35 by way of shaft 41 is a document gate 42 (preferably transparent) adapted to respectively pivot into and out of engagement with the edge 34 of the base plate 30, thereby respectively closing off and establishing communication between the transport channel 36 and the alignment area 30*a*. Specifically, the document gate 42 includes a main body 42*a* having at its forward edge a channel shaped member 43 defined by upper and lower lips 43*a* and 43*b* joined by the edge portion 43*c*. Joined with the upper lip 43*a* is an inclined portion 44, the end of which is disposed above and spaced from a project 45. There is thus defined a pair of communicating document passageways 46 and 47 through which documents 1 can pass when the gate 42 has dropped into engagement with the base plate edge 34. It is specifically noted that when the gate 42 has so pivoted to this engaged position, the edge portion 43*c* is behind the inclined surface 39, the channel member 43 providing an obstruction between the channel 36 and the major alignment area or portion 30*a* of the base plate.

The document gate 42 also includes an extension portion 146 having an opening 146*a* therein for the purpose subsequently described.

Partially disposed within an opening 147 in the base plate 30 and in front of inclined surface 39 (in direction of document transport) is a transport roller 48 driven (by means not shown) in the direction of arrow 49, the purpose of which is to completely advance the envelopes exiting from the channel 36 of the housing 35 onto the major portion 30*a* of the base plate 30. In this regard, a leaf member 50 is pivotally mounted with the shaft 41 and has an end portion 50*a* spring biased toward engagement with the transport roller 48 (through the opening 146*a*), thereby urging the documents 4 exiting the channel 36 against the transport roller 48 for complete advancement into the main alignment area 30*a*. A leaf spring member 51 is also connected at one end to the housing 35, its opposite end being resiliently biased against documents passing along the base plate to compensate for any frictional drag imposed to the transported documents by the document gate 42.

In accordance with a key feature of the invention, the document gate 42 (and specifically the edge portion 43*c* of the channel shaped member 43 thereof) provides means for aligning the trailing edge of documents 4 entering the alignment assembly, as well as the side edge 1*a* of the documents 1. Specifically, the edge portion 43*c* is oriented substantially perpendicular to an axis passing through the aligned openings in the clamps 15 so that when either the trailing edge of the document 4 of the side edge 1*a* of the document 1 is urged against the edge 43*c* (by way of the operation of the document aligner assembly 60, the details of which are subsequently described), the edge of the document which is similarly urged into the openings of the clamps is substantially linearly aligned in such openings.

The urging of either documents 1 or 4 which have entered the main alignment area 30*a* against the edge 43*c* and into the openings of the clamps is effected by a document aligner assembly 60 comprising a uniquely designed pair of vibrating document transporters 61 positioned below the base plate 30 with the forward tips of elastomer members 61*a* extending through respective openings 70 in the base plate 30. The details and operation of each of these document transporters 61 are more specifically described in U.S. Pat. No. 3,747,921, assigned to the assignee of the present invention, it only being necessary to point out at this time that the tip members 61*a* are electromechanically vibrated to transport any document urged thereagainst in the desired direction. Specifically, the tip members 61*a* are skewed at an appropriate angle (say, 15° from an axis passing perpendicular to the axis of the aligned openings of the clamps 15) toward the alignment edge 43*c* so that the vibratory action of the tips 61*a* not only urges documents in the area 30*a* toward the clamps, but also toward edge 43*c*.

Cooperating with the document transporters 61 are a pair of free-turning back-up rollers 62 appropriately coupled with a roller support shaft 63 by way of arms 64. The roller shaft 63 is rotatably mounted (by means not shown) to pivot the back-up rollers 62 respectively toward and away from engagement with the tips 61*a*, the shaft normally being spring biased in its "up" position (rollers out of engagement) and rotated to its "down" position (rollers engaged) by a solenoid assembly (not shown) controlled by signals from a photosensor assembly 65 disposed immediately adjacent the document gate 42. The roller support shaft 63 is positioned above the base plate 30 disposed substantially parallel to the axis of the openings in the set of clamps 15; and the rollers 62 are skewed at essentially the same angle as the tips 61*a* of the document transporters 61. It is thus observed that when the roller support shaft 63 is rotated to position the back-up rollers 62 against (or immediately adjacent) the vibrating transporters 61, any document disposed in the major portion 30*a* of the base plate is simultaneously advanced toward the clamps 15 and against the alignment edge 43*c*, thus inserting the so-advanced documents into the openings of the clamps in a manner which accurately and firmly positions the forward edge of the document to be clamped within all the parallel disposed clamps. It is noted that the pivoting of the back-up rollers away from engagement with tips 61*a* is to allow clearance for documents entering the major alignment area 30*a*.

In accordance with a specific feature of the disclosed assembly, the arms 64 are journably mounted to, and for limited movement around, the roller support shaft 63 and springs 68 disposed around the support shaft have free ends respectively connected with the arms 64 to spring bias the rollers 62 toward the transporter tips 61*a*. As a consequence of this feature, automatic adjustment is provided for documents of varying thickness or temperature changes which may affect the clearance between the transporter tips and the back-up rollers for documents advanced therethrough.

The operation and use of the alignment assenbly is now described. As previously mentioned, suitable control apparatus is employed for the overall system depicted in FIG. 1 to separately insert either a document 1 or a document 4 into the alignment assembly 10. Specifically, with respect to the documents being transported along the transport path A, a document 1 enters the assembly over the up-turned end 31 with its edge 1*a* passing through the guide passageways 46 and 47 in the document gate 42. At this time is should be noted that the document gate 42 has pivoted into engagement with the edge 34. As the leading edge of the so inserted document passes over the sensor element of the photosensor assembly 65, the roller support shaft 63 (which was previously in its up position) is rotated in response to the actuation of the solenoid to pivot the rollers 62 toward the document transporters 61, thus lightly pinching the document against the tips 61*a.* At substantially the same time, the document transporter 61 are energized and the resulting vibratory motion thereof aligns the edge 1*a* of the document 1 against the edge portion 43*c* and within the clamps 15 resulting in the accurate alignent of the document within these clamps. The transport belt assembly 20 (FIG. 1) is then actuated, pulling the document out of the assembly 10 and past the print apparatus 11. After the trailing edge of the document clears the photosensor assembly 65, the solenoid is deenergized and the spring biased shaft 63 rotates to pivot the rollers 62 away from engagement with the tips 61*a;* and the document transporters 61 are deenergized, thus preparing the document aligner assembly 60 for entry of the next document.

With regard to the documents being transported along the transport path B into the alignment assembly 10, a document 4 passes through the housing 35 and is driven under the document gate 42 which, at this time, is in pivotal engagement with the edge 34. The so-inserted document travels up the inclined surface 39 and, as a result, pivots the document gate 42 to an upward position off of the surface 34, allowing the document to pass onto the major portion 30*a* of the base plate (aided by the cooperation of the driven transport roller 48 and leaf member 52 urging the document against the roller).

When the trailing edge of the document 4 clears the area of the inclined surface 39 (document now within area 30*a*), the document gate 42 drops back into engagement with the shelf 34. The transport roller 48 (and leaf 50) insures that the entire document is advanced into the alignment area 30*a* to enable the gate to return to its original position. As before, the leading edge of the document 4 passes by the sensor element of the photosensor assembly, thus pivoting the rollers 62 (after an appropriate delay) into engagement with the now energized transporters 61, the entire aligner assembly 60 again urging the document (now the elongated edge of envelope 4) into the clamps 15 and against the alignment edge 43*c* for accurate alignment of the document within the clamps. The belt assembly is acutated as before, the envelope is removed from the assembly 10, and the apparatus is now set to receive another one of either a document 1 or 4 after deactuation of rollers 62 and transporters 61.

Various other modifications to the disclosed embodiment, as well as alternate embodiments, of the present invention may become apparent to one skilled in the art without departing from the spirit and scope of the invention as defined by the appended claims.

What is claimed is:

1. Alignment apparatus for aligning separate sets of documents wherein at least one of said sets includes documents such as conventional envelopes, said apparatus disposed at the intersection of transversely oriented first and second transport paths along which said sets of documents are respectively transported for aligning respective ones of said documents in a document engaging means of a transport assembly with said document engaging means positioned substantially perpendicular to said first one of said transport paths, comprising:

a. document guide edge means disposed in an orientation substantially perpendicular to said document engaging means and parallel to said first transport path;

b. a document support plate defining respective first and second passageways in communication with said first and second transversely oriented transport paths, respectively; and c. means for advancing a document from either of said sets of documents along said support plate simultaneously toward said document guide edge means and said document engaging means, thereby to accurately align said documents with said document engaging means.

2. The apparatus as defined by claim 1 including document gate means mounted to pivot into and out of blocking engagement with said second passageway along which said envelopes are transported, said document gate means including said document guide edge means.

3. The appratus as defined by claim 2 wherein said document gate means includes means defining a document channel in alignment with both of said passageways.

4. The apparatus as defined by claim 3 wherein said document support plate has a portion recessed relative to the remainder of said plate and said document gate means is adapted to pivot into engagement with said recessed portion.

5. The apparatus as defined by claim 1 wherein said advancing means comprises a document aligner assembly including vibrating transporter means disposed below and extending through openings in said document support plate and a cooperating roller assembly pivotally movable toward and away from engagement with said document transporter means.

6. The apparatus as defined by claim 5 wherein said vibrating transporter means are skewed at an angle toward said document guide edge means.

7. The apparatus as defined by claim 6 wherein said roller assembly is spring biased toward said vibrating transporter means.

* * * * *